US005446985A

United States Patent [19]

Chen

[11] Patent Number: 5,446,985

[45] Date of Patent: Sep. 5, 1995

[54] FLASH LIGHT COMBINED WITH A TEAR GAS INJECTOR

[75] Inventor: Han-Liang Chen, Taipei, Taiwan

[73] Assignee: Motedo Co., Ltd., Taipei, Taiwan

[21] Appl. No.: 333,439

[22] Filed: Nov. 2, 1994

[51] Int. Cl.[6] ..... F41C 9/00; F21V 33/00

[52] U.S. Cl. ..... 42/1.08; 222/3; 222/192; 362/96

[58] Field of Search ..... 42/1.08, 1.16, 103; 222/3, 192; 362/96, 110

[56] References Cited

U.S. PATENT DOCUMENTS

| | | | |
|---|---|---|---|
| 2,625,764 | 1/1953 | O'Brien et al. | 42/1.08 |
| 3,638,836 | 2/1972 | Vickers, III | 222/113 |
| 4,449,474 | 5/1984 | Mariol | 362/96 |
| 5,086,377 | 2/1992 | Roberts | 42/1.08 |
| 5,307,249 | 4/1994 | Vanwynsberghe | 362/96 |
| 5,331,523 | 7/1994 | Delzer | 42/1.08 |
| 5,373,427 | 12/1994 | McLean | 362/96 |

*Primary Examiner*—Charles T. Jordan
*Assistant Examiner*—Theresa M. Wesson
*Attorney, Agent, or Firm*—William E. Pelton

[57] ABSTRACT

A self-defense device includes a flash light and a tear-gas dispenser. The flash light includes a head, a first cylinder connected with the head, a second cylinder connected with the first cylinder, and a reflector receivable in the head and a pipe formed through the reflector. The funnel includes a conical portion and a tubular portion. The funnel is receivable in the first cylinder. A flexible tube is connected between the tubular portion of the funnel and the pipe. A bottle includes a nipple. Tear gas will exit from the bottle through the nipple if the nipple is pressed. The bottle is receivable in the first cylinder while the nipple is insertable in the conical portion of the funnel. A first bottle-driving element includes a piston and two plates projecting from the piston. Each of the plates of the first bottle-driving element includes an inclined edge. The first bottle-driving element is receivable in the first cylinder so that the piston thereof is in contact with the bottle. A second bottle-driving element includes an inclined surface, a protrusion projecting downwardly therefrom and a boss projecting upwardly therefrom. The second bottle-driving element is receivable in the first cylinder. If the button is pressed, the nipple will be pressed by means of the funnel as the inclined edges of the plates of the first bottle-driving element are engageable with the inclined surface of the second bottle-driving element.

2 Claims, 3 Drawing Sheets

FLASH LIGHT COMBINED WITH A TEAR GAS INJECTOR

BACKGROUND OF THE INVENTION

This invention relates to a self-defense flash light combined with a tear-gas dispenser.

As threats to personal safety are increasing, the importance of self-defense devices increases accordingly. Weapons, e.g., pistols, are useful as self-defense devices; however, weapons are not easily available to ordinary people or commercial security personnel in many countries. Tear gas dispensers, electrical-shock devices and truncheons are used by ordinary people or commercial security personnel. There has been at least one combination of a flash light with a tear-gas dispenser. However, in such a combination, the direction in which light is emitted from the flash light is opposed to the direction in which tear gas is dispersed from the tear-gas dispenser. Therefore, a user has to turn the combination by 180° so that he/she can disperse the tear gas forwards.

SUMMARY OF THE INVENTION

It is the primary objective of this invention to provide a self-defense device including a flash light and a tear-gas dispenser so that the flash light and the tear-gas dispenser face the same direction.

The primary objective of this invention is achieved by means of providing a self-defense device including a flash light with a tear-gas dispenser.

The flash light includes a hollow head, a first electrically conductive cylinder connected with the hollow head, a second electrically conductive cylinder connected with the first electrically conductive cylinder, a first electrically isolating sleeve receivable in the first electrically conductive cylinder, a second electrically isolating cylinder receivable in the second electrically conductive cylinder, a reflector receivable in the hollow head, a pipe formed through the reflector, an annular mount secured in the first electrically conductive cylinder, a socket receivable in the annular mount, a bulb receivable in the socket so that the bulb is within the reflector, a bracket including a first disk for supporting the socket, a second disk defining a central aperture and an eccentric aperture and a D-shaped portion formed between the first and second disks wherein the a bracket is secured in the first electrically conductive cylinder, a switch attached to the bracket, a first button slidably receivable in the first aperture defined in the first electrically conductive cylinder so as to be in contact with the switch, a conductor including a disk defining a central aperture, a pin projecting from a surface of the disk and a tubular clip projecting from an opposite surface of the disk wherein the conductor is receivable in the first electrically conductive cylinder so that the disk is in contact with the first electrically conductive cylinder and that the pin projecting from the conductor is insertable through the eccentric aperture defined in the second disk of the bracket so as to be electrically connected with the switch, a first spring receivable in the second electrically isolating cylinder, a wire electrically connected between the first spring and the second electrically conductive cylinder and a plurality of dry batteries receivable in the second electrically isolating cylinder so that a negative electrode of one of the dry batteries is in contact with the first spring.

The tear-gas dispenser includes a funnel including a hollow conical portion and a tubular portion projecting from the hollow conical portion wherein the tubular portion of the funnel is insertable through the central aperture defined in the second disk of the bracket and the central aperture defined in the disk of the conductor while the hollow conical portion of the funnel is retained in the tubular clip of the conductor, a flexible tube for connecting the tubular portion of the funnel with the pipe, an electrically conductive tear-gas bottle including a nipple projecting therefrom wherein the electrically conductive tear-gas bottle is receivable in the first electrically isolating sleeve while the nipple thereof is insertable in the hollow conical portion of the funnel, a first bottle-driving element including a piston and two plates projecting from the piston and each including an inclined edge, a first electrically conductive block secured to the piston of the first bottle-driving element wherein the first electrically conductive block is in contact with the electrically conductive tear-gas bottle while the first bottle-driving element is receivable in the first electrically conductive cylinder, a second bottle-driving element including an inclined surface, a protrusion projecting downwardly from a lower horizontal surface and a boss projecting upwardly from an upper horizontal surface wherein the second bottle-driving element is receivable in the first electrically conductive cylinder so that the inclined edges of the plates of the first bottle-driving element are engageable with the inclined surface of the second bottle-driving element, a second spring located between the plates of the first bottle-driving element while the protrusion of the second bottle-driving element is insertable in the second spring, a second button in the form of a cap mounted on the boss of the second bottle-driving element while the second button is insertable through the second aperture defined in the first electrically conductive cylinder and a disk receivable in the first electrically conductive cylinder, a second electrically conductive block secured to the disk wherein the second electrically conductive block is electrically connected with the first electrically conductive block, an annular electrically isolating plug secured in the first electrically conductive cylinder for retaining the conductor, the funnel, the electrically conductive tear-gas bottle, the first bottle-driving element, the second bottle-driving element, the second spring and the disk within the first electrically conductive cylinder while the second electrically conductive block is insertable through the annular electrically isolating plug so as to be in contact with a positive electrode of one of the dry batteries.

DETAILED DESCRIPTION OF THE PREFERRED EMBODIMENT

Figure 1:
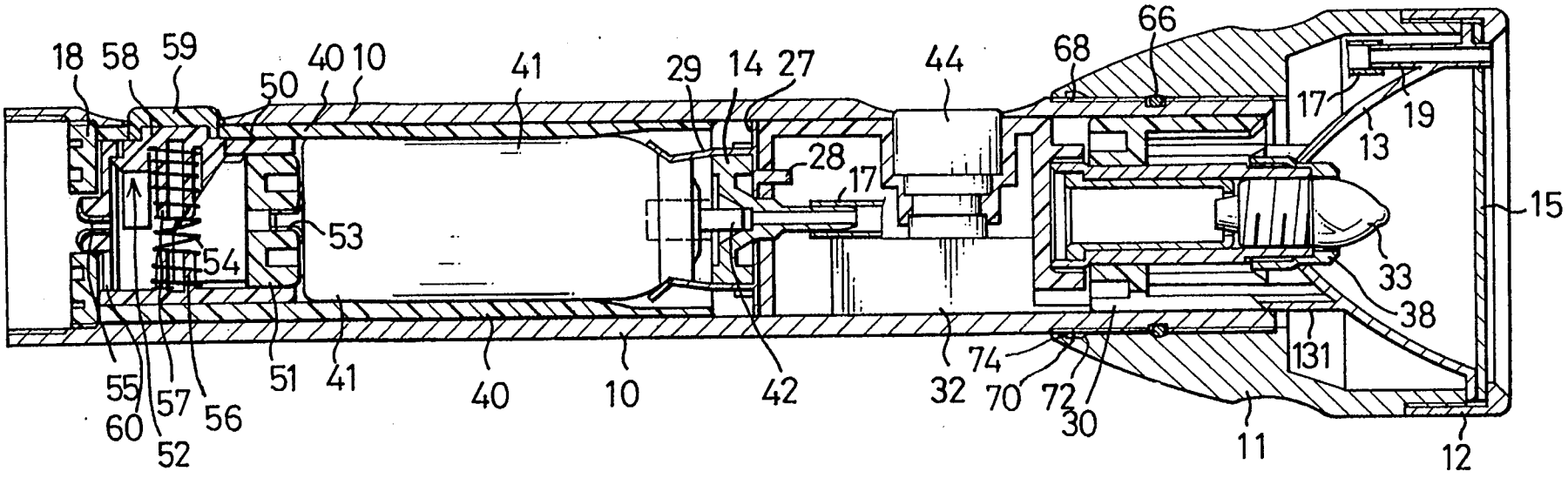
FIG. 1 is a partial cross-sectional view of the preferred embodiment of a flash light with a tear-gas dispenser according to this invention.
Figure 2:
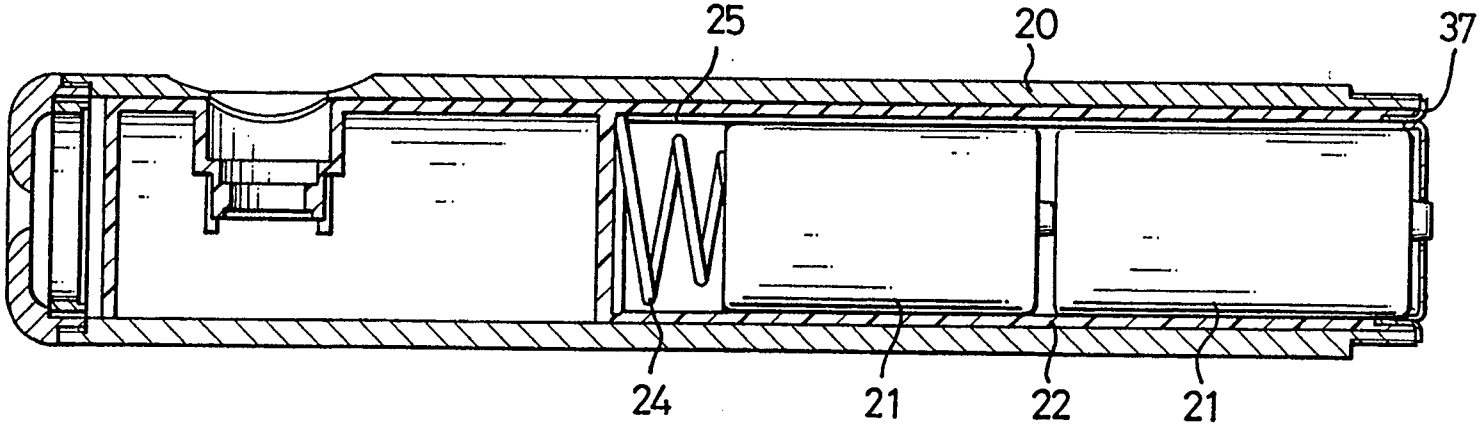
FIG. 2 is another partial cross-sectional view of the preferred embodiment of a flash light with a tear-gas dispenser according to this invention.
Figure 3:
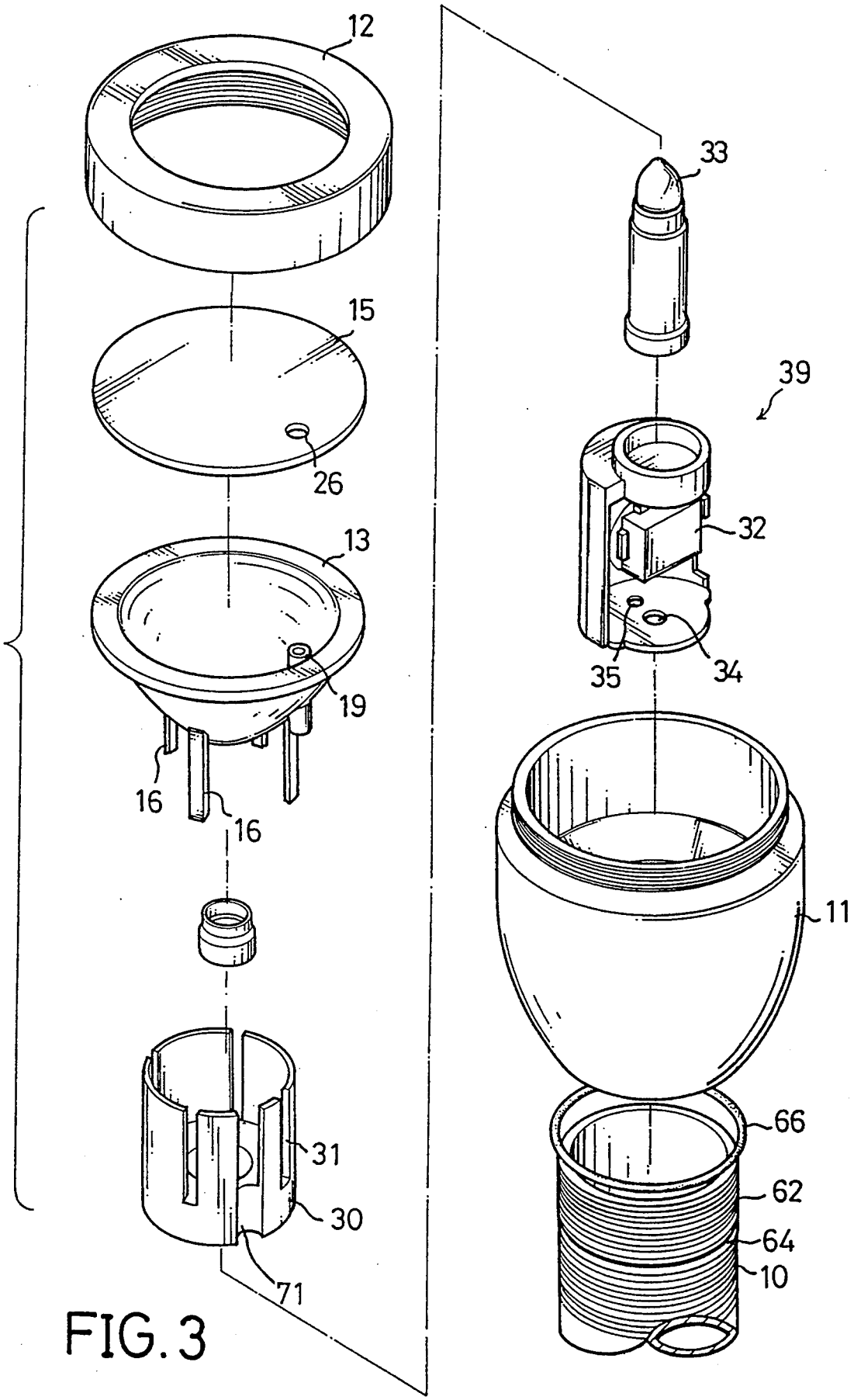
FIG. 3 is a partial exploded view of the preferred embodiment of a flash light with a tear-gas dispenser according to this invention.

In the following detailed description of the preferred embodiment, a cylinder is a hollow cylindrical element.

Referring to the drawings, a self-defense device includes a hollow head 11, a first cylinder 10 threadably connected with the hollow head 11 and a second cylinder 20 threadably connected with the first cylinder 10.

The first cylinder 10 is made of electrically conductive material. The first cylinder 10 defines a first aperture (not numbered) near a first end portion and a second aperture (not numbered) near a second end portion. A thread 62 is formed on an external surface of the cylinder 10 near the first end portion. An annular groove 64 is defined in the external surface of the first cylinder 10 within the thread 62. A ring 66 is receivable in the annular groove 64.

A bulb 33 is threadably receivable in a socket 38 which is insertable in an annular mount 30 secured in the first cylinder 10 in the first end portion. A plurality of slits 31 are defined in the annular mount 30. A cutout 71 is defined in the annular mount 30.

The hollow head 11 includes a thread 68 formed on an internal surface and an annular groove 70 defined in the internal surface within the thread 68. As shown in FIG. 1, the annular groove 70 is defined so as to form a first annular wall 72 inclined from the internal surface of the hollow head 11 and a second annular wall 74 perpendicular to the internal surface of the hollow head 11.

To mount the hollow head 11 on the first cylinder 10, the hollow head 11 is rotated clockwise relative to the first cylinder 10 so as to move the hollow head 11 on the first cylinder 10, as the thread 62 is engageable with the thread 68, until the hollow head 11 is stopped by means of the ring 66. The ring 66 is compressible so that the hollow head 11 is further movable on the first cylinder 10 so that the ring 66 will be receivable in the annular groove 70. The ring 66 will expand as it enters the annular groove 64 so that the hollow head 11 is further movable on the first cylinder 10 as the first annular first annular wall 72 is movable past the ring 66 and that the hollow head 11 is not movable on the first cylinder 10 in an opposed direction as the second annular wall 74 is abutted against the ring 66, thus retaining the hollow head on the first cylinder 10.

A reflector 13 is receivable in the hollow head 11. A plurality of slides 16 project from the reflector 13. The slides 16 are receivable in the slits 31 so that the reflector 13 will not be rotated while the hollow head 11 is rotated on the first cylinder 10 in order to adjust focus of the flash light. A pipe 19 is formed on an edge of the reflector 13.

A lens 15 defining an aperture 26 is mounted on the reflector 13 while the aperture 26 is in communication with the pipe 19. The hollow head 11 is threadably connected with an annular frame 12 for retaining the reflector 13 and the lens 15 within the hollow head 11.

By means of operation of a switch 32, the bulb 33 is switchable between ON and OFF positions. The switch 32 is attached to a bracket 39. The bracket 39 includes a first disk, a second disk and a D-shaped portion formed between the first and second disks. The D-shaped portion of the bracket 39 defines an opening (not numbered). An annular flange is formed on the first disk of the bracket 39. The second disk of the bracket 39 defines a central aperture 34 and an eccentric aperture 35. The bracket 39 is receivable in the first cylinder 10. The socket 38 is receivable in the annular flange formed on the first disk of the bracket 39.

A button 44 is insertable through the first aperture defined in the first cylinder 10 and the opening defined in the D-shaped portion of the bracket 39. The button 44 is in contact with the switch 32. The switch 32 is switchable between the ON and OFF positions by means of pressing the button 44.

A conductor 27 includes a disk defining a central aperture (not numbered), a pin 28 projecting from a surface of the disk and a tubular clip 29 projecting from an opposed surface of the disk.

The conductor 27 is receivable in the first cylinder 10. The central aperture defined in the conductor 27 is in communication with the central aperture 34 defined in the second disk of the bracket 39. The pin 28 is insertable through the eccentric aperture 35 defined in the second disk of the bracket 39. The pin 28 is electrically connected with the switch 32 by any appropriate means.

A funnel 14 is made of electrically material. The funnel 14 includes a hollow conical portion and a tubular portion projecting axially from the hollow conical portion. An annular shoulder is formed on an internal surface of the hollow conical portion of the funnel 14. The funnel 14 is retained in the tubular clip 29. The tubular portion of the funnel 14 is insertable through the central aperture defined in the conductor 27 and the central aperture defined in the second disk of the bracket 39. A flexible tube 17 is directed through the cutout 71 in order to connect between the tubular portion of the funnel 14 with the pipe 19.

A first electrically isolating cylinder 40 is receivable in the first cylinder 10. An electrically conductive bottle 41 includes a nipple 42 projecting therefrom. Metal bottles filled with tear gas are commercially available. The tear gas will exit from the bottle 41 through the nipple 42 as the nipple 42 is pressed. The electrically conductive bottle 41 is receivable in the first electrically isolating cylinder 40 while the nipple 42 is insertable in the hollow conical portion of the funnel 14.

A collar 50 is made of electrically material. The collar 50 includes a cutout (not numbered) defined therein and a protrusion 56 projecting upwardly from an internal surface thereof. The collar 50 is secured in the first electrically isolating cylinder 40. The aperture defined in the first electrically isolating cylinder 40 is aligned with the cutout defined in the collar 50.

A first bottle-driving element 51 is made of electrically material. The first bottle-driving element 51 includes a piston, a hole (not numbered) defined in a first surface of the piston and two plates (not numbered) projecting from a second surface of the piston. A first electrically conductive block 53 is secured in the hole defined in the first surface of the piston of the first bottle-driving element. Each of the plates of the first bottle-driving element 51 includes an inclined edge (not numbered). The first bottle-driving element 51 is receivable in the first electrically isolating cylinder 40 so that the first electrically conductive block 53 is in contact with the electrically conductive tear-gas bottle 41.

A second bottle-driving element 52 is made of electrically material. The second bottle-driving element 52 includes a protrusion 57 formed on a lower horizontal surface, a boss 58 formed on an upper horizontal surface and an inclined surface (not numbered). The second bottle-driving element 52 is receivable in the collar 50 so that the boss thereof is insertable through the cutout defined in the collar 50. The protrusion 57 is located between the plates. The inclined edges of the plates of the first bottle-driving element 51 are engageable with the inclined surface of the second bottle-driving element 52. A spring 54 is mounted on the protrusions 56 and 57 for biasing the second bottle-driving element 52. A button 59 is mounted on the boss 58.

If the button 59 is pressed, the electrically conductive bottle 41 will be pushed towards the funnel 14 as the first bottle-driving element 51 is engageable with the second bottle-driving element 52. Thus, the nipple 42 is abutted against the annular shoulder formed on the internal surface of the hollow conical portion of the funnel 14, i.e., the nipple 42 is pressed. As a result, the tear gas is exiled from the bottle 41 through the nipple 42. The tear gas will be transmitted through the flexible tube 17 so as to be dispensed from the pipe 19.

A second electrically conductive block 55 is secured in a hole (not numbered) defined in a disk 60 receivable in the first electrically isolating cylinder 40. The first electrically conductive block 53 is electrically connected with the second electrically conductive block 55 by means of a wire (not shown).

An annular plug 18 is made of electrically material. The annular plug 18 is secured in the first cylinder 10 near the second end portion.

The second cylinder 20 is made of electrically conductive material. The second cylinder 20 defines an opening in an end portion, The second electrically isolating cylinder 22 defines an opening in an end portion, The second electrically isolating cylinder 22 is receivable in the second cylinder 20. A spring 24 is made of electrically conductive material. The spring 24 is receivable in the second electrically isolating cylinder 22. Two dry batteries 21 are receivable in the second electrically isolating cylinder 22. A negative electrode of one of the dry batteries 21 is in contact with the spring 24 while a positive electrode of the remaining dry battery 21 is in contact with the second electrically conductive block 55. The spring 24 is electrically connected by means of a wire 25 with an electrically conductive strip 37. The electrically conductive strip 37 is in contact with the second electrically conductive cylinder 20.

I claim:

1. A self-defense device comprising:

a flash light comprising:

a hollow head, a first electrically conductive cylinder threadably connected with the hollow head, a second electrically conductive cylinder threadably connected with the first electrically conductive cylinder, a first electrically isolating sleeve receivable in the first electrically conductive cylinder, a second electrically isolating cylinder receivable in the second electrically conductive cylinder, a reflector receivable in the hollow head, a pipe formed through the reflector, an annular mount secured in the first electrically conductive cylinder, a socket receivable in the annular mount, a bulb receivable in the socket so that the bulb is within the reflector, a bracket including a first disk for supporting the socket, a second disk defining a central aperture and an eccentric aperture and a D-shaped portion formed between the first and second disks wherein the bracket is secured in the first electrically conductive cylinder, a switch attached to the bracket, a first button slidably receivable in a first aperture defined in the first electrically conductive cylinder so as to be in contact with the switch, and a conductor including a disk defining a central aperture, a pin projecting from a surface of the disk and a tubular clip projecting from an opposite surface of the disk wherein the conductor is receivable in the first electrically conductive cylinder so that the disk is in contact with the first electrically conductive cylinder and that the pin projecting from the conductor is insertable through the eccentric aperture defined in the second disk of the bracket so as to be electrically connected with the switch, a first spring receivable in the second electrically isolating cylinder, a wire electrically connected between the first spring and the second electrically conductive cylinder, and a plurality of dry batteries receivable in the second electrically isolating cylinder so that a negative electrode of one of the dry batteries is in contact with the first spring; and a tear-gas dispenser comprising:

a funnel including a hollow conical portion and a tubular portion projecting from the hollow conical portion wherein the tubular portion of the funnel is insertable through the central aperture defined in the second disk of the bracket and the central aperture defined in the disk of the conductor while the hollow conical portion of the funnel is retained in the tubular clip of the conductor, a flexible tube for connecting the tubular portion of the funnel with the pipe, an electrically conductive tear-gas bottle including a nipple projecting therefrom wherein the electrically conductive tear-gas bottle is receivable in the first electrically isolating sleeve while the nipple thereof is insertable in the hollow conical portion of the funnel, a first bottle-driving element including a piston and two plates projecting from the piston and each including an inclined edge, a first electrically conductive block secured to the piston of the first bottle-driving element wherein the first electrically conductive block is in contact with the electrically conductive tear-gas bottle while the first bottle-driving element is receivable in the first electrically conductive cylinder, a second bottle-driving element including an inclined surface, a protrusion projecting downwardly from a lower horizontal surface and a boss projecting upwardly from an upper horizontal surface wherein the second bottle-driving element is receivable in the first electrically conductive cylinder so that the inclined edges of the plates of the first bottle-driving element are engageable with the inclined surface of the second bottle-driving element, a second spring located between the plates of the first bottle-driving element while the protrusion of the second bottle-driving element is insertable in the second spring, a second button in the form of a cap mounted on the boss of the second bottle-driving element while the second button is insertable through a second aperture defined in the first electrically conductive cylinder and a disk receivable in the first electrically conductive cylinder, a second electrically conductive block secured to the disk wherein the second electrically conductive block is electrically connected with the first electrically conductive block, and an annular electrically isolating plug secured in the first electrically conductive cylinder for retaining the conductor, the funnel, the electrically conductive tear-gas bottle, the first bottle-driving element, the second bottle-driving element, the second spring and the disk within the first electrically conductive cylinder while the second electrically conductive block is insertable through the annular electrically isolating plug so as to be in contact with a positive electrode of one of the dry batteries.

2. A self-defense device according to claim 1 including a ring, wherein the first cylinder includes an external surface, a thread formed on the external surface and an annular groove defined in the external surface for receiving the ring, wherein the hollow head includes an internal surface, a thread formed on the internal surface and an annular groove defined in the internal surface within the thread, wherein the annular groove is defined so as to form a first annular wall inclined from the internal surface and a second annular wall perpendicular to the internal surface;

wherein the hollow head is rotatable clockwise on the first cylinder so as to move the hollow head on the first cylinder in order to mount the hollow head on the first cylinder, as the thread of the hollow head is engageable with the thread of the first cylinder, until the hollow head is stopped by means of the ring, wherein the ring is compressible so that the hollow head is further movable on the first cylinder in order to move the ring into the annular groove defined in the hollow head, wherein the ring will expand as it enters the annular groove defined in the hollow head so that the hollow head is further movable on the first cylinder as the first wall of the hollow head is movable past the ring and that the hollow head is not movable on the first cylinder in an opposed direction as the second annular wall of the hollow head is abutted against the ring, retaining the hollow head on the first cylinder.

* * * * *